US008922612B2

(12) United States Patent
Paoletti et al.

(10) Patent No.: US 8,922,612 B2
(45) Date of Patent: Dec. 30, 2014

(54) THERMAL PRINTING

(75) Inventors: Richard Steven Paoletti, Spencerport, NY (US); Gregory James Garbacz, Rochester, NY (US)

(73) Assignee: Kodak Alaris Inc., Rochester, NY (US)

( * ) Notice: Subject to any disclaimer, the term of this patent is extended or adjusted under 35 U.S.C. 154(b) by 543 days.

(21) Appl. No.: 13/032,926

(22) Filed: Feb. 23, 2011

(65) Prior Publication Data

US 2012/0212561 A1 Aug. 23, 2012

(51) Int. Cl.
*B41J 15/16* (2006.01)
*B41J 2/32* (2006.01)

(52) U.S. Cl.
CPC ... *B41J 15/16* (2013.01); *B41J 2/32* (2013.01)
USPC ..... 347/218

(58) Field of Classification Search
USPC ..... 347/171, 172, 174, 176, 215, 218
See application file for complete search history.

(56) References Cited

U.S. PATENT DOCUMENTS

| | | | | |
|---|---|---|---|---|
| 4,720,714 | A * | 1/1988 | Yukio | 346/134 |
| 5,264,873 | A | 11/1993 | Fiscella et al. | |
| 7,777,773 | B2 * | 8/2010 | Ng et al. | 347/240 |
| 8,328,318 | B2 * | 12/2012 | Igarashi et al. | 347/16 |
| 2008/0122917 | A1 * | 5/2008 | Higuchi | 347/215 |

* cited by examiner

*Primary Examiner* — Huan Tran
(74) *Attorney, Agent, or Firm* — Hogan Lovells US LLP

(57) ABSTRACT

A method of printing feeds a receiver through a print head area using a pair of feed rollers comprising a pinch roller and a capstan roller. A preselected tension is maintained on the receiver that is supplied to the feed rollers by controlling a rotation speed of a supply roll that provides the receiver to the feed rollers. The receiver is printed and reverse fed in an opposite direction while controlling the tension of the receiver in response to a tension of the receiver that exists between the feed rollers and the print head area during the step of reverse feeding. Maintaining the tension includes providing a motor having a torque limiter.

14 Claims, 7 Drawing Sheets

THERMAL PRINTING

CROSS REFERENCE TO RELATED APPLICATIONS

Reference is made to commonly assigned, U.S. patent application Ser. No. 13/032,897 by Paoletti et al. filed on even date herewith entitled "Thermal Printer" the disclosure of which is incorporated herein by reference in its entirety.

FIELD OF THE INVENTION

The present invention is directed to thermal printing. In particular, a printer apparatus and method is disclosed for printing on receiver media without damaging the media.

BACKGROUND OF THE INVENTION

Currently, most thermal printers achieve acceptable color to color image registration by the use of a capstan roller having sharp peaks, as shown in FIGS. 3A-B, which penetrate the receiver for optimum traction to avoid slippage during receiver transport. While this presents no grave problems for a simplex print, since the marks produced are on the back side of the print, for duplex printing this unimproved method leaves noticeable impression marks on receiver media constructed with a dual-sided voided layer. The impression marks appear in the image area of the print. These impression marks, or depressions, do not allow dye from the dye donor web to reach the receiver media which leaves behind discolored areas on the print, such as white dots. It is noted that the present invention is not limited in any way only to duplex printing methods because the non perforating design of the presently disclosed methods and apparatuses can be implemented in non-duplex printing systems.

SUMMARY OF THE INVENTION

Preferred embodiments of the present invention incorporate the use of a less aggressive capstan roller design along with a softer pinch roller to eliminate impression marks in the thermal receiver. To compensate for the less aggressive grip on the receiver, a tension differential across the capstan is controllably decreased. By increasing tension in the receiver on the roll side of the capstan during printing, an acceptable color to color image registration is produced. The capstan uses a straight (longitudinal) knurl pattern with ridges running along the length of the roller parallel to its axis of rotation, as shown in FIGS. 4A-B. The ridges are disposed at a frequency of 10 to 30 ridges per inch. The depth of these ridges being at least 10 microns. Other methods of achieving high traction, non-marking surfaces include the use of plasma coatings, thin elastomeric coatings, and increasing the wrap angle of the receiver around the capstan. In the case of a duplex printer, this invention is applicable whether the printer incorporates a single web path with print heads on both sides of the receiver or separate web paths for individually imaging each side of the sheet.

The pinch roller of a preferred embodiment of the present inventions is composed of a steel shaft covered with an elastomeric material having a shore-A durometer ranging from 20 to 60, with a 50 micron Teflon sleeve covering the elastomer. The tension of the receiver between the receiver roll and the capstan, region 108, produced during a printing phase should be maintained at more than 50% of the tension existing between the capstan and the thermal print head, region 107. This amounts to less than 50% tension differential across the capstan roller. These preferred embodiments of the invention do not require slowing down the print speed.

A preferred embodiment of the present invention includes a method of printing comprising feeding a receiver through a print head area using a pair of feed rollers comprising a pinch roller and a capstan roller. A preselected tension is maintained on the receiver that is supplied to the feed rollers by controlling a rotation speed of a supply roll that provides the receiver to the feed rollers. The receiver is printed and reverse fed in an opposite direction while controlling the tension of the receiver in response to a tension of the receiver that exists between the feed rollers and the print head area during the step of reverse feeding. Maintaining the tension includes providing a motor having a torque limiter for driving the supply roll and for controlling the rotation speed of the supply roll. The capstan roller includes a high traction, non-marking surface. Maintaining tension includes setting the preselected tension in proportion to a tension of the receiver that exists between the capstan roller and the print head area during printing.

Another preferred embodiment of the present invention includes a method of feeding a receiver between a longitudinally knurled capstan roller and a pinch roller comprising an elastomeric material thereon having a shore-A durometer measurement ranging from 20 to 60 for preventing perforation of a dual sided voided layer receiver. A tension of the receiver is adjusted on adjacent sides of the capstan and pinch roller in a preselected proportion based upon a registration performance of a print head printing on the receiver. The registration performance includes in-track registration and cross-track registration. A tension of the receiver on one of the adjacent sides of the capstan and pinch roller, where the receiver enters the capstan and pinch roller, is adjusted to be at least half the tension of the other of the adjacent sides.

Another preferred embodiment of the present invention includes a method of printing comprising feeding a thermal receiver toward a print head area using a pair of feed rollers comprising a pinch roller and a capstan roller, printing the thermal receiver, and examining the print on the thermal receiver that was fed at least in part by the step of feeding the thermal receiver. A tension of the receiver is adjusted on the side that is supplied to the pair of feed rollers. This is performed in response to the step of examining for correcting a registration of the thermal receiver. This tracking error is detected by the examining step. The step of adjusting includes adjusting a torque limiter in a motor that drives the thermal receiver that is supplied to the pair of feed rollers. Alternatively, the motor can drive a supply spool where the thermal receiver is wound. The motor can also be installed to drive a pair of rollers that feeds the receiver from the supply spool.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. For example, the summary descriptions above are not meant to describe individual separate embodiments whose elements are not interchangeable. In fact, many of the elements described as related to a particular embodiment can be used together with, and possibly interchanged with, elements of other described embodiments. Many changes and modifications may be made within the scope of the present invention without departing from the spirit thereof, and the invention includes all such modifications. It is also noted that other approaches to this problem could include eliminating the capstan and letting the platen roller be the main drive roller or in the case of a duplex printer, filling in or coating over the holes left by the capstan before printing over them, The figures below are intended to be drawn neither to any precise scale with respect to relative size, angular relationship, or relative position nor to any combinational relationship with respect to interchangeability, substitution, or representation of an actual implementation.

DETAILED DESCRIPTION OF THE INVENTION

Figure 1:
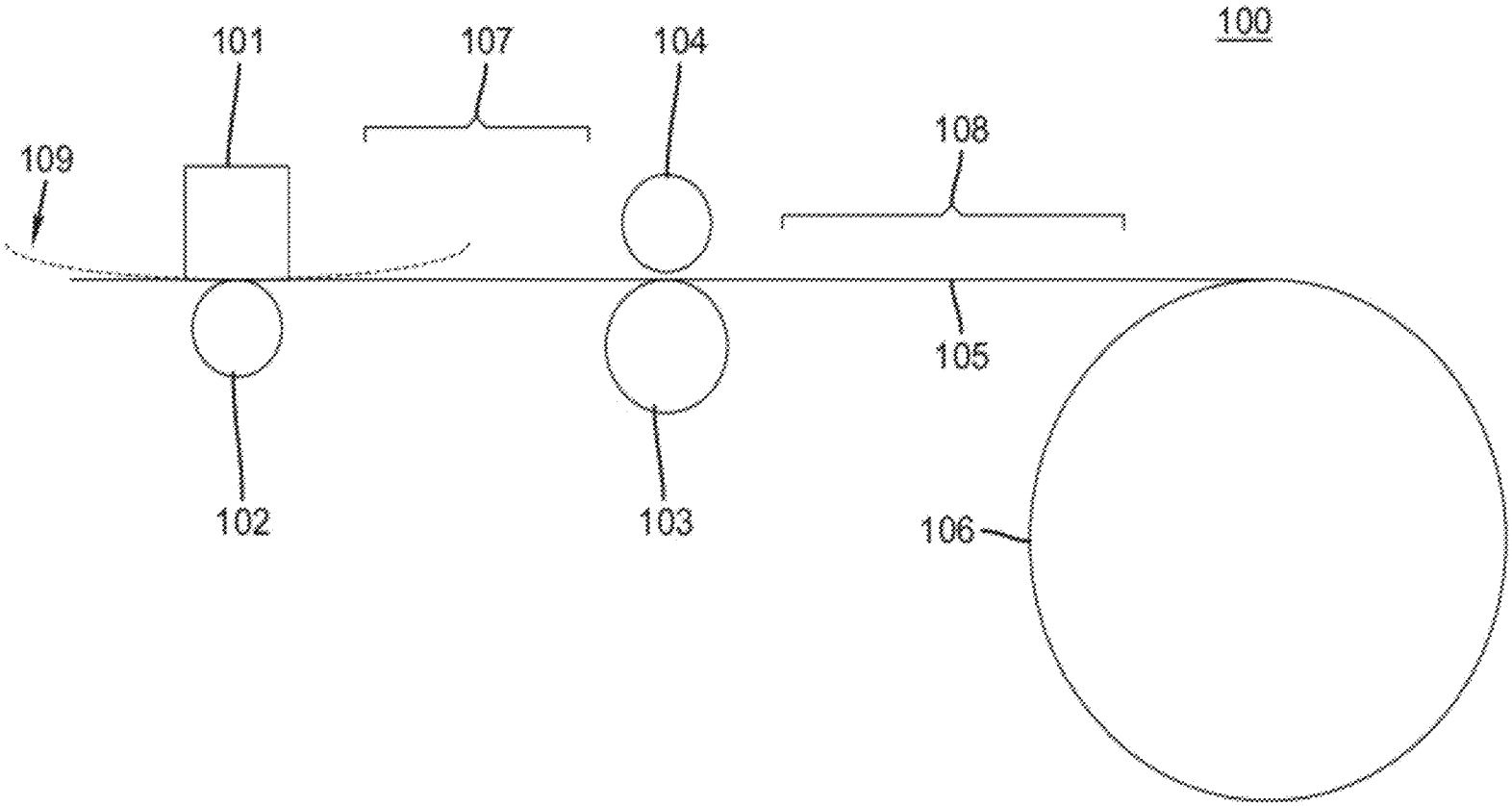
FIG. 1 illustrates a receiver feed mechanism.

With reference to FIG. 1 there is illustrated a portion of a thermal printer's drive system. A roll 106 of receiver 105 is fed through a thermal printer 100 as shown by the receiver advancing past thermal print head 101, as fed by thermal roller 102, pinch roller 104 and capstan roller 103. Dye donor web 109 (partially illustrated) is applied onto the receiver in predetermined patterns, as is well known in the art. The receiver is iteratively reversed and printed during several color applications of the dye donor web in the predetermined patterns. Tension in approximate region 107 relative to approximate region 108 affect an ability of the capstan and pinch rollers to effectively control movement of the receiver therethrough.

Figure 3B:
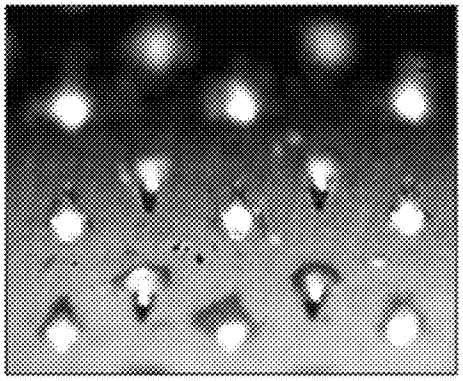
FIGS. 3A-B illustrate views of a sharp point capstan roller.
Figure 4B:
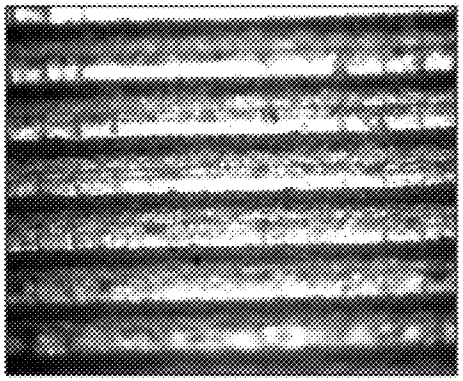
FIGS. 4A-B illustrate views of a longitudinal knurled roller.
Figure 3A:
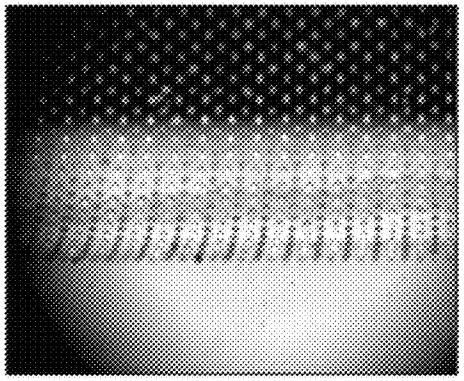
Figure 4A:
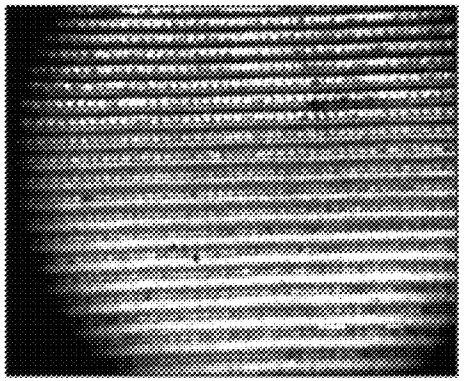

A preferred embodiment of the present invention comprises a less aggressive capstan roller 103 design, as is illustrated in FIGS. 4A-B wherein a knurled pattern provides a spike free configuration that does not perforate a surface of receiver 105 as would the spiked configuration of the capstan roller shown in FIG. 3A-B. Together with a softer pinch roller 104, impression marks are not formed in the thermal receiver as it passes between capstan and pinch rollers 103, 104. To compensate for the less aggressive grip on the receiver, a tension differential across the capstan in approximate regions 107 and 108 is decreased. By increasing tension in the receiver on the roll side of the capstan 108 during printing, an acceptable color to color image registration is produced. This increase in the tension in approximate area 108 reduces the tension differential across capstan roller 103.

Figure 2:
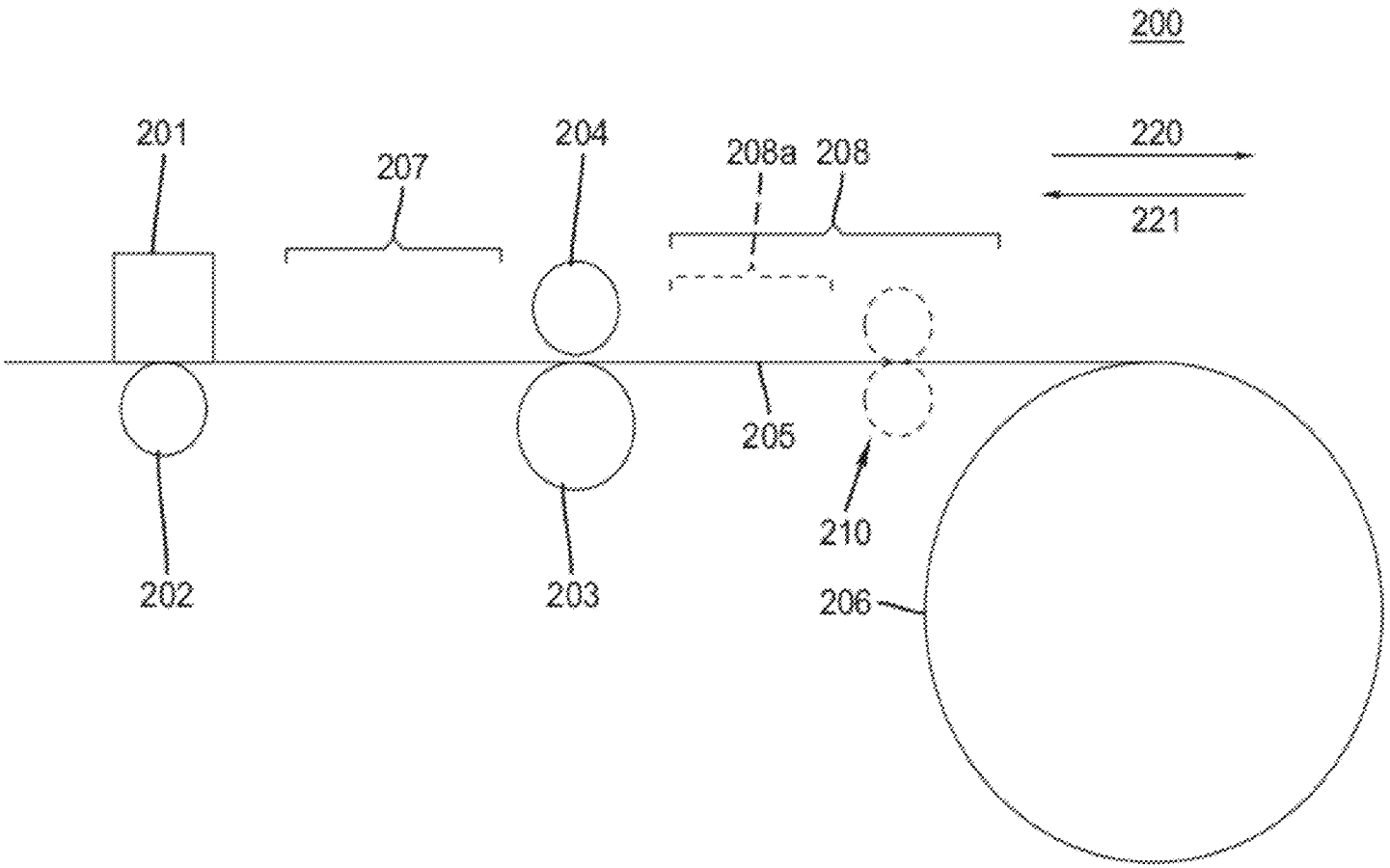
FIG. 2 illustrates a receiver feed mechanism with tension control rollers.

Referring to FIG. 2, control of the tension in approximate region 208 of the receiver can be achieved by providing a properly sized clutch (torque limiter) on the output of the drive motor for receiver roll 206 (not shown). The clutch control can be used to adjust tension in the receiver in approximate region 208. An alternative method for controlling the tension in approximate region 208 of the receiver includes adding rollers 210 which would likewise be driven by a motor with a properly sized clutch on its output. This would reduce the length of controlled tension approximate region 208 to that approximate portion indicated by the dashed line bracket 208*a*. In a preferred embodiment, roll 206 or rollers 210 would feed receiver 205 faster than the capstan, thus causing the clutch to slip and maintain a constant torque, during a forward feed printing phase of printer 100 and reverse feed the receiver slower than the capstan, again causing the clutch to slip and maintain a constant torque during its rewind phase. Both of these adjustments, one each for forward feed and for reverse feed, increase tension in the receiver in approximate region 208.

The capstan 203 uses a straight knurl pattern with ridges running along the length of the roller parallel to its axis of rotation as shown in FIGS. 4A-B. The ridges are disposed at a frequency of 10 to 30 ridges/cm at a depth of at least 10 microns.

The pinch roller is composed of a steel shaft covered with an elastomeric material with a shore-A durometer ranging from 20 to 60, with a 50 micron Teflon sleeve covering the elastomer. This preferred embodiment is a softer and thinner version of conventional elastomer roller covers. A softer pinch roller aids in eliminating marks in the receiver but often results in more slippage of the receiver due to lower traction. Controlling tension in the receiver on both sides of the capstan roller can reduce or eliminate slippage. The tension of the receiver between the receiver roll and the capstan, approximate region 108, produced during printing should be more than about 50% of the tension existing between the capstan and the thermal print head, approximate region 107. This percentage is higher than the unregulated tension commonly existing in thermal printers.

The clutched motor, either used for roll 206 or for rollers 210, or both, is designed to provide a predesigned load, which controls an amount of tension applied to the receiver at approximate region 108. Manual trial and error clutch adjustment can be fine tuned by monitoring performance of the printer, then manually leaving the clutch set at the desired adjustment point. This procedure can be undertaken during the design phase to establish a factory setting. Depending on the design of the printer, characteristics such as thermal head drag and capstan traction might require more or less tension between the receiver roll and the capstan to achieve proper image registration. The receiver roll diameter ranges from about 7 inches diameter when full to about 3.5 inches when depleted for the spool diameter, which should be compensated by controlling motor speed and torque during depletion of the receiver media. In an eight inch printer width, a full roll weighs approximately 5-6 pounds. If the clutch is driving the paper roll, the RPM of the motor output must be determined based on the smallest possible roll diameter during the printing cycle and on the largest possible diameter during the rewind cycle to insure that the clutch slips and maintains tension properly. If the clutch is driving a second pair of rollers, for example, the alternate rollers 210, the roll diameter is not a concern.

The clutch operates by attaching part of it to the shaft and another concentric part attached to a drive component such as a gear or pulley. These two parts of the clutch are coupled to each other only by friction which produces a limited amount of torque when slippage of one half relative to the other occurs. Typically, this friction coupling is adjustable for controlling an amount of mechanically transmitted torque.

To determine a value of the torque that the clutch must transmit to the receiver to achieve accurate registration, the torque can be varied in a stepwise fashion until the color to color registration is within specification. Some possible ways to vary the torque to determine an acceptable value are to use an adjustable clutch, a series of fixed-value clutches or a pulley and weight system attached to the paper roll. This same technique can be used whether the clutch is driving the paper roll or a second pair of rollers. The precision of the tension control will depend on the gripping capability of the capstan roller. The less the gripping capability, the more tension control is required.

Other more precise methods of controlling tension include (1) the use of a three-roll cluster, the middle roller being a "dancer" roller which has a wrap angle of approximately 180° and exerts a constant force on the web (receiver); and (2) using a closed-loop system in which a tension sensor feeds back a signal to a DC motor which drives either the receiver roll 206 or the second pair of rollers 210.

Figure 5:
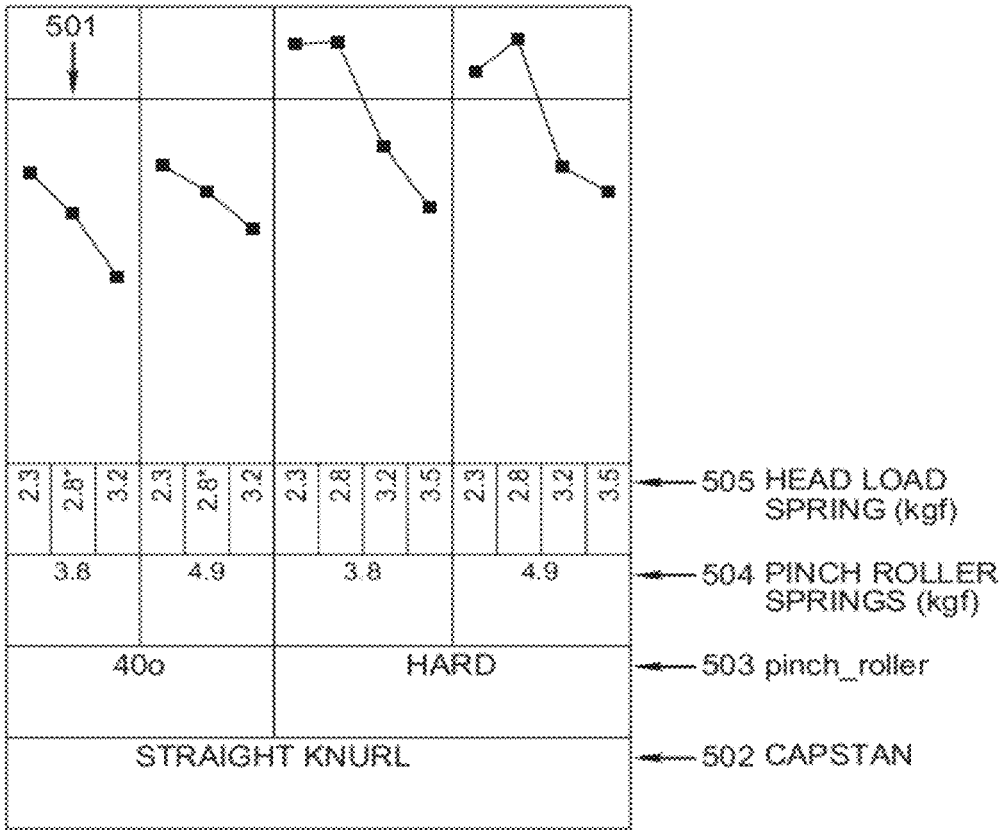
FIG. 5 illustrates in-track data points using different modifications.

With reference to FIG. 5, experimental testing measured in-track registration, i.e. same direction as receiver movement through the printer, with resulting data points as shown in this figure. Testing procedures used straight knurl capstan roller 502, as described above, varying pinch roller hardness modifications 503, different pinch roller pressure modifications as applied with pinch roller springs 504, and different print head load pressure modifications 505, also applied via springs. There is a data point for each of these different print head load pressure modifications 505 shown in the graph, which tests were repeated using the different pinch roller modifications and pinch roller pressure modifications as shown. Horizontal baseline 501 line indicates a preferred minimum in-track performance of about −6 thousandths of an inch. To illustrate the scale of the graph shown relative to this −6 performance, the data point at head load spring 505 value 3.2, pinch roller spring 504 value 3.8, and pinch roller 503 value 40 shore A durometer, shows an in-track performance of approximately −18 thousandths of an inch.

Figure 6:
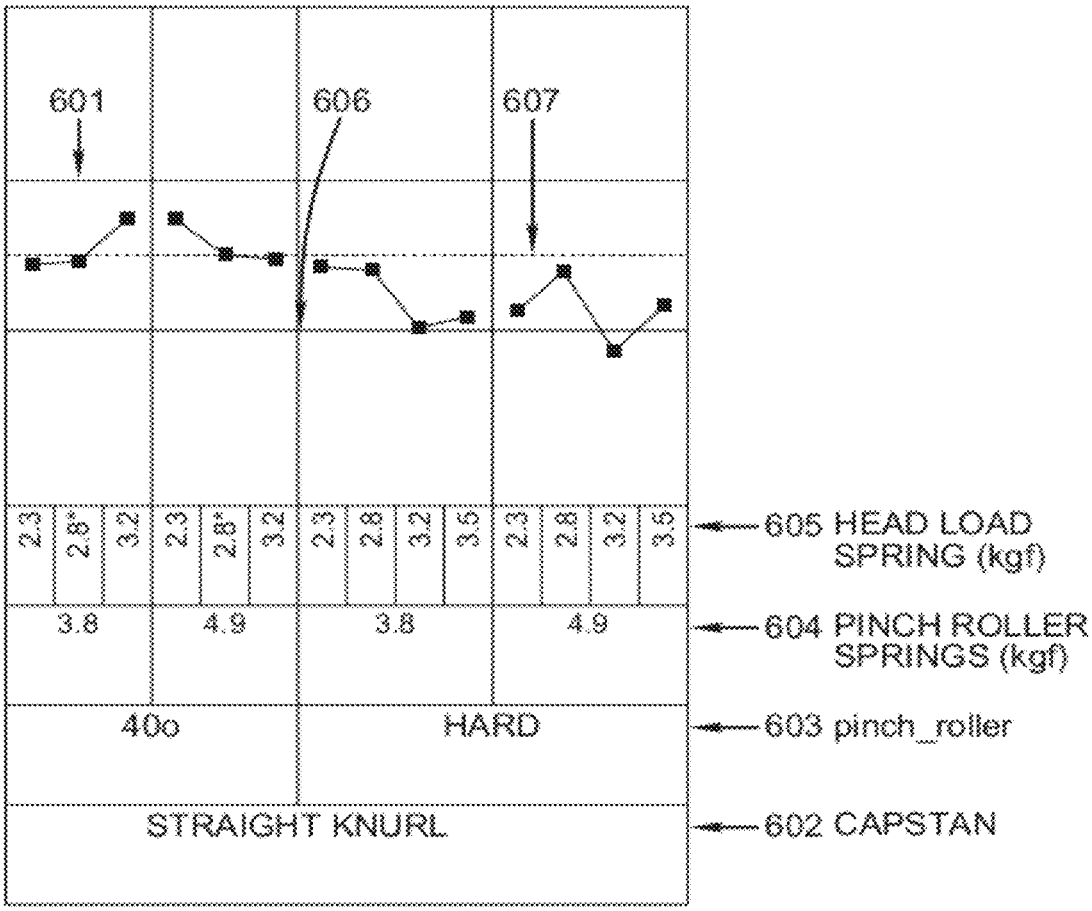
FIG. 6 illustrates cross-track data points using different modifications.

With reference to FIG. 6, experimental testing measured cross-track registration, i.e. perpendicular to in-track registration, with resulting data points as shown in this figure. Testing procedures used straight knurl capstan roller 602, as described above, varying pinch roller hardness modifications 603, different pinch roller pressure modifications as applied with pinch roller springs 604, and different print head load pressure modifications 605, also applied via springs. There is a data point for each of these different print head load pressure modifications 605 shown in the graph, most of which tests were repeated using the different pinch roller modifications and pinch roller pressure modifications as shown. Horizontal baselines 601, 606 indicate a preferred performance window between +6 thousandths of an inch 601 and −6 thousandths of an inch 606, with zero cross-track error indicated by dotted line 607. The two performances closest to zero cross-track error indicated in this figure was achieved with pinch roller hardness of 40 shore A durometer, pinch roller spring tension (measured in kgf) of 4.9, and head load spring magnitude (also measured in kgf) 2.8 and 3.2.

Figure 7:
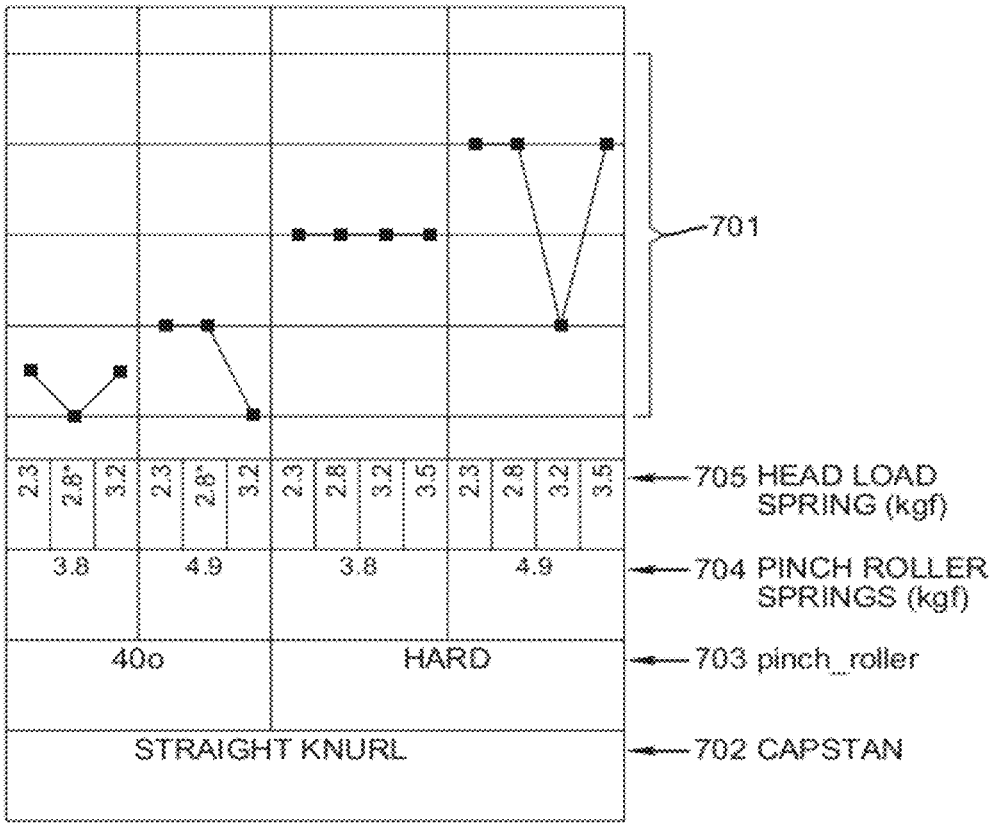
FIG. 7 illustrates impression mark data points using different modifications.

With reference to FIG. 7, experimental testing measured impression marks in the receiver caused by the capstan 702, with resulting data points as shown in this figure. Testing procedures used straight knurl capstan roller 702, as described above, varying pinch roller hardness modifications 703, different pinch roller pressure modifications as applied with pinch roller springs 704, and different print head load pressure modifications 705, also applied via springs. There is a data point for each of these different print head load pressure modifications 705 shown in the graph, most of which tests were repeated using the different pinch roller modifications and pinch roller pressure modifications as shown. Horizontal baselines 701 indicate resulting performance. The lowest line indicates that the impression is invisible to the naked eye and requires a loop to be seen; the second lowest horizontal line indicates an impression mark that can be seen by the naked eye but is not obvious. The remaining three horizontal lines indicate, in an upward progression, increasingly noticeable impression marks. Performance having less noticeable impression marks is preferred.

Figure 8A:
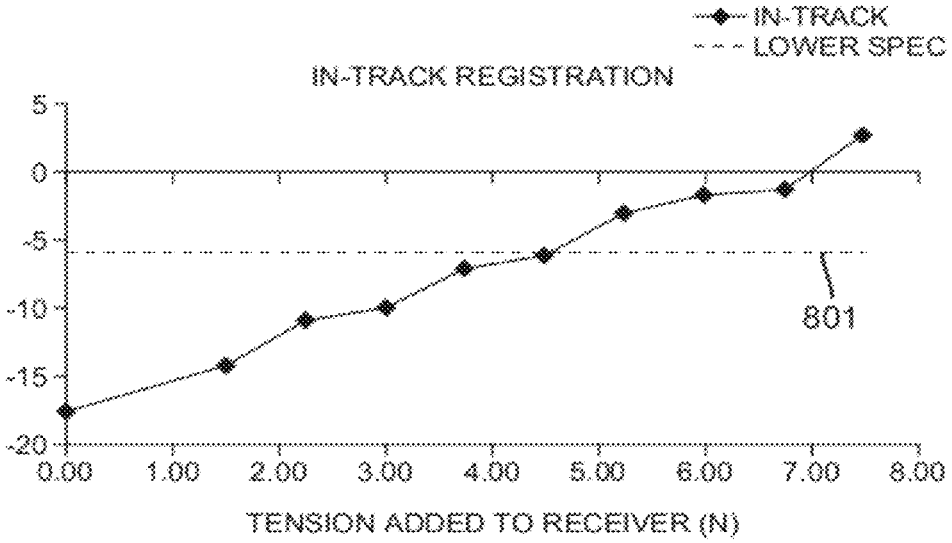
FIGS. 8A-B illustrate in-track and cross-track registration performance using different receiver tensions.
Figure 8B:
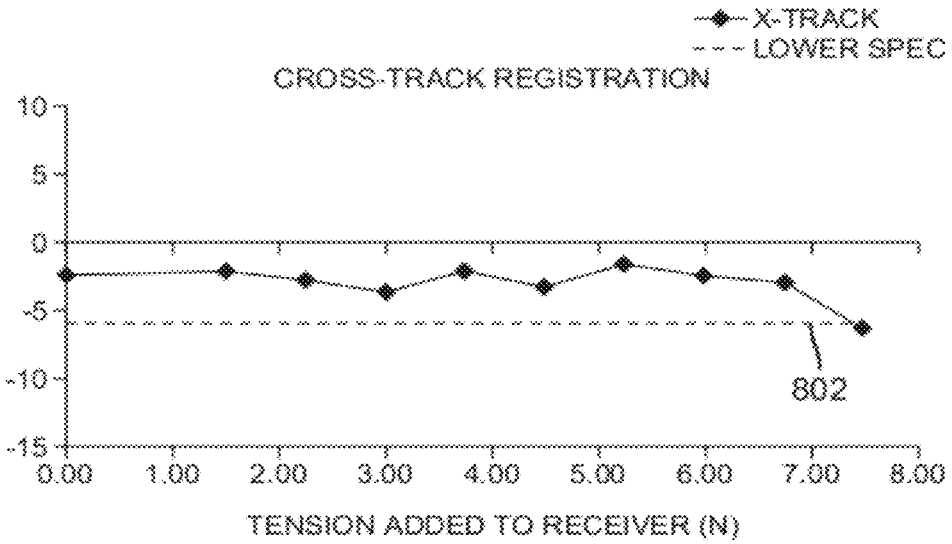

With reference to FIGS. 8A and 8B, experimental testing measured in-track and cross-track registration, respectively, with varying tension applied to the receiver in region 108, with resulting data points as shown in this figure. Testing procedures were undertaken by measurably controlling the torque applied to roll 106. Horizontal baselines 801, 802 indicate a preferred minimum in-track and cross-track performance of about −6 thousandths of an inch. As is illustrated in FIG. 8A, in-track registration with zero error is achieved using approximately 7 newtons of added tension. Cross-track registration, shown in 8B, begins to deviate below the baseline with added tension of this magnitude.

PARTS LIST

100 Printing System
101 Print Head
102 Roller
103 Roller
104 Roller
105 Receiver
106 Supply Roll
107 Receiver region
108 Receiver region\
109 Donor
200 Printing System
201 Print Head
202 Roller
203 Roller
204 Roller
205 Receiver
206 Supply Roll
207 Receiver region
208 Receiver region
208*a* Receiver region
210 Rollers
220 Direction
221 Direction
501 Horizontal line
502 Field
503 Field
504 Field
505 Field
601 Upper axis
602 Field
603 Field
604 Field
605 Field
606 Lower axis
607 Zero axis
701 Horizontal axes
702 Field
703 Field
704 Field
705 Field
801 Lower axis
802 Lower axis

The invention claimed is:

1. A method of printing on a receiver comprising:

feeding the receiver in a first feed direction through a print head area using a pair of feed rollers comprising a pinch roller and a capstan roller; and maintaining a preselected tension on the receiver that is supplied to the feed rollers by controlling a rotation speed of a supply roll that provides the receiver to the pair of feed rollers.

2. The method of claim 1, further comprising:

printing on the receiver; and reverse feeding the receiver in a second feed direction, including controlling the tension of the receiver in response to a tension of the receiver that exists between the feed rollers and the print head area during the step of reverse feeding.

3. The method of claim 1, wherein the step of maintaining includes providing a motor having a torque limiter for driving the supply roll and for controlling the rotation speed of the supply roll.

4. The method of claim 3, wherein the step of maintaining further includes providing the capstan roller with a high traction, non-marking surface.

5. The method of claim 1, wherein the step of maintaining includes setting the preselected tension in proportion to a tension of the receiver that exists between the capstan roller and the print head area during the step of printing.

6. A method of printing comprising the steps of:

feeding a receiver between a longitudinally knurled capstan roller and a pinch roller comprising an elastomeric material thereon having a shore-A durometer measurement ranging from 20 to 60 for preventing perforation of the receiver; and adjusting a tension of the receiver on adjacent sides of the capstan and pinch roller in a preselected proportion based upon a registration performance of a print head printing on the receiver.

7. The method of claim 6, wherein the registration performance is a tracking performance including in-track registration and cross-track registration.

8. The method of claim 6, wherein the receiver includes a dual sided voided layer and the capstan roller does not penetrate into a voided layer of the receiver.

9. The method of claim 6, wherein the preselected proportion is such that a tension of the receiver on one of the adjacent sides of the capstan and pinch roller is at least half the tension of the other of the adjacent sides, said one of the adjacent sides being a side where the receiver enters the capstan and pinch roller.

10. A method of printing comprising:

feeding a thermal receiver toward a print head area using a pair of feed rollers comprising a pinch roller and a capstan roller;

printing the thermal receiver;

examining the print on the thermal receiver that was fed at least in part by the step of feeding the thermal receiver; and responsive to examining the print, adjusting a tension on the thermal receiver that is supplied to the pair of feed rollers.

11. The method of claim 10 wherein the step of adjusting includes correcting a tracking error that is detected by the step of examining.

12. The method of claim 10 wherein the step of adjusting includes adjusting a torque limiter in a motor that drives the thermal receiver that is supplied to the pair of feed rollers.

13. The method of claim 12 wherein the motor drives a supply spool whereupon the thermal receiver is wound.

14. The method of claim 12 wherein the motor drives a pair of rollers that feeds the receiver from a supply spool whereupon the thermal receiver is wound.

* * * * *